United States Patent [19]

de Bentzmann

[11] Patent Number: 4,532,966

[45] Date of Patent: Aug. 6, 1985

[54] DEVICE FOR PRODUCING AND REMOVING SHAPED WIRE MATERIAL PIECES

[76] Inventor: Bertrand L. de Bentzmann, Bragueze, 47800 Roumagne, France

[21] Appl. No.: 482,830

[22] Filed: Apr. 7, 1983

[30] Foreign Application Priority Data

Apr. 21, 1982 [FR] France ..... 82 06864

[51] Int. Cl.[3] ..... B21F 1/00

[52] U.S. Cl. ..... 140/105; 72/384; 72/388

[58] Field of Search ..... 140/105; 72/217, 218, 72/381, 384, 387, 388, 320, 321, 323

[56] References Cited

U.S. PATENT DOCUMENTS

| | | | |
|---|---|---|---|
| 1,739,249 | 12/1929 | Menne | 72/384 |
| 2,055,955 | 9/1936 | Wagenbach | 72/388 |
| 3,369,574 | 2/1968 | Horne | 140/105 |
| 3,584,660 | 6/1971 | Paine | 140/105 |
| 3,901,064 | 8/1975 | Jacobson | 72/388 |
| 4,121,628 | 10/1978 | Waligore et al. | 140/105 |

FOREIGN PATENT DOCUMENTS

| | | | |
|---|---|---|---|
| 348265 | 8/1972 | U.S.S.R. | 72/388 |

*Primary Examiner*—Lowell A. Larson
*Assistant Examiner*—Linda McLaughlin
*Attorney, Agent, or Firm*—Dennison, Meserole, Pollack & Scheiner

[57] ABSTRACT

The invention relates to a device for producing and removing shaped wire material pieces wherein said device comprises a frame which is supplied with bars, said bars being supplied to measuring, cutting and shaping means mounted on the frame, which latter rests on the ground by way of supporting legs defining a space under the frame to allow the passage of a moving tray on which the pieces are unloaded for removal after shaping.

8 Claims, 13 Drawing Figures

DEVICE FOR PRODUCING AND REMOVING SHAPED WIRE MATERIAL PIECES

The present invention relates to a device for producing and removing shaped wire material pieces.

To shape wires or bars such as those used to reinforce concrete, it has been known up to now to use devices restricted to the production of closed or open frames, and excluding the production of elongated pieces.

The object of the present invention is a device which is designed to automatically measure, cut and shape this type of elongated pieces, the removal of the pieces being integrated to the device and differentiated so as to present the finished pieces in groups to suit the requirements of an assembly.

The device according to the present invention comprises a movable frame which is supplied with bars, said bars being supplied to measuring, cutting and shaping means mounted on the frame, which latter rests on the ground by way of supporting legs defining a space under the frame to allow the passage of a moving tray on which the pieces are unloaded for removal after shaping.

Figure 1:
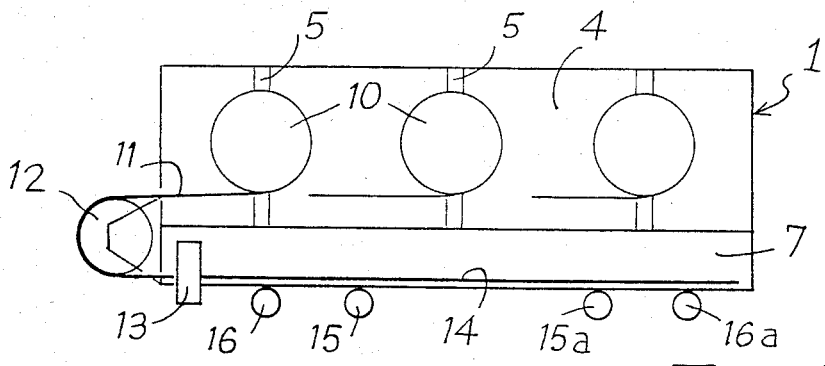
Figure 2:
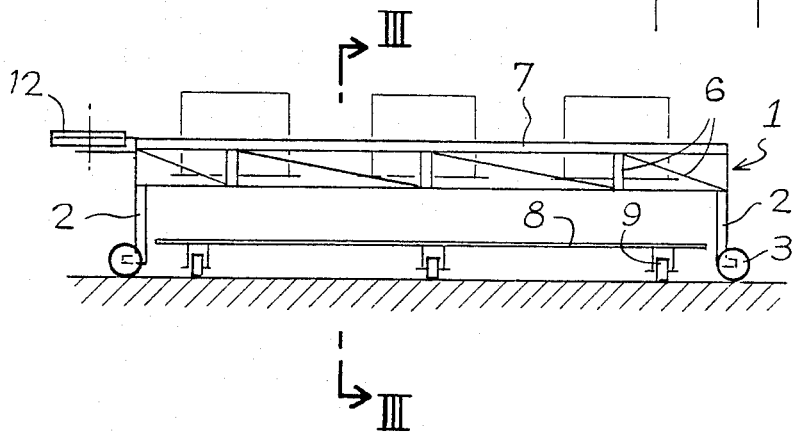
Figure 3:
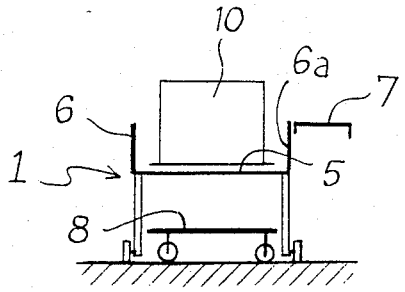
Figure 3A:
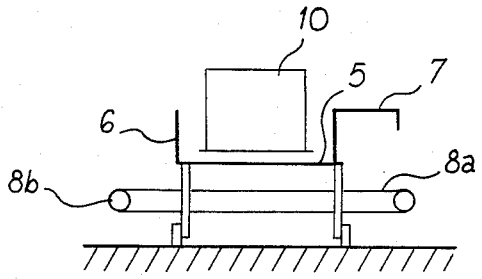
Figure 10A:
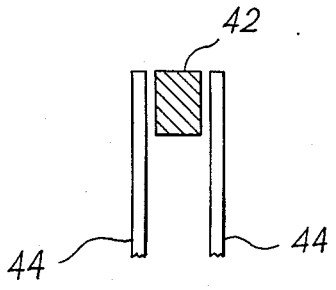
Figure 4:
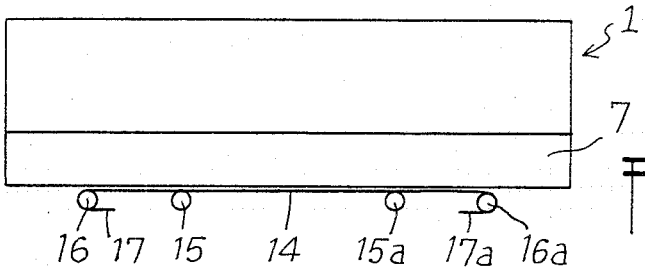
Figure 5:
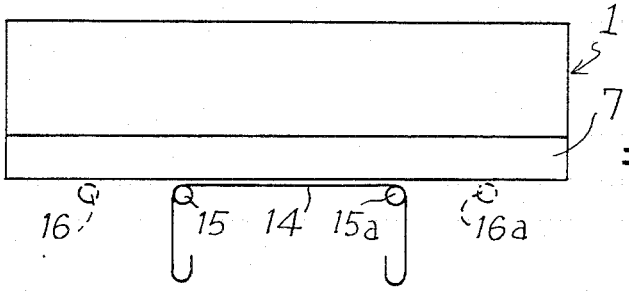
Figure 6:
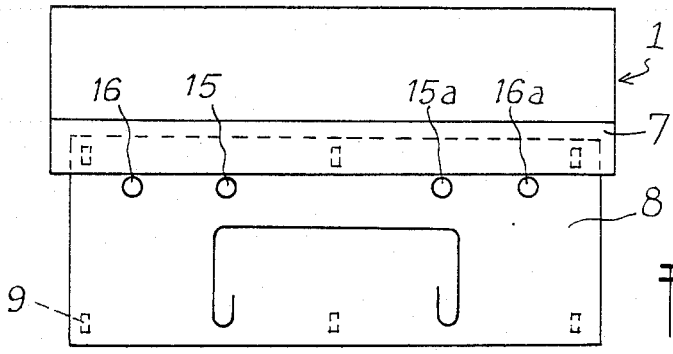
Figure 7:
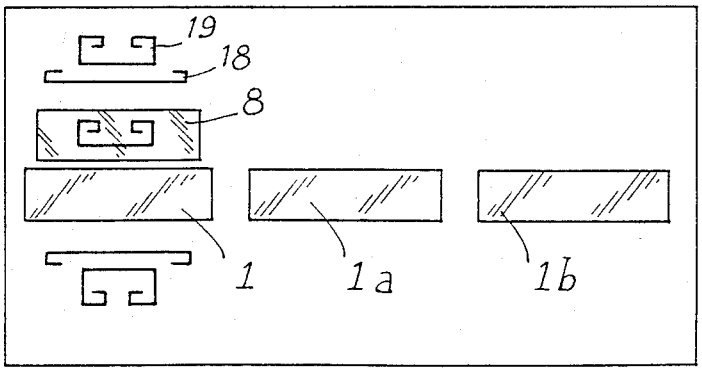
Figure 8:
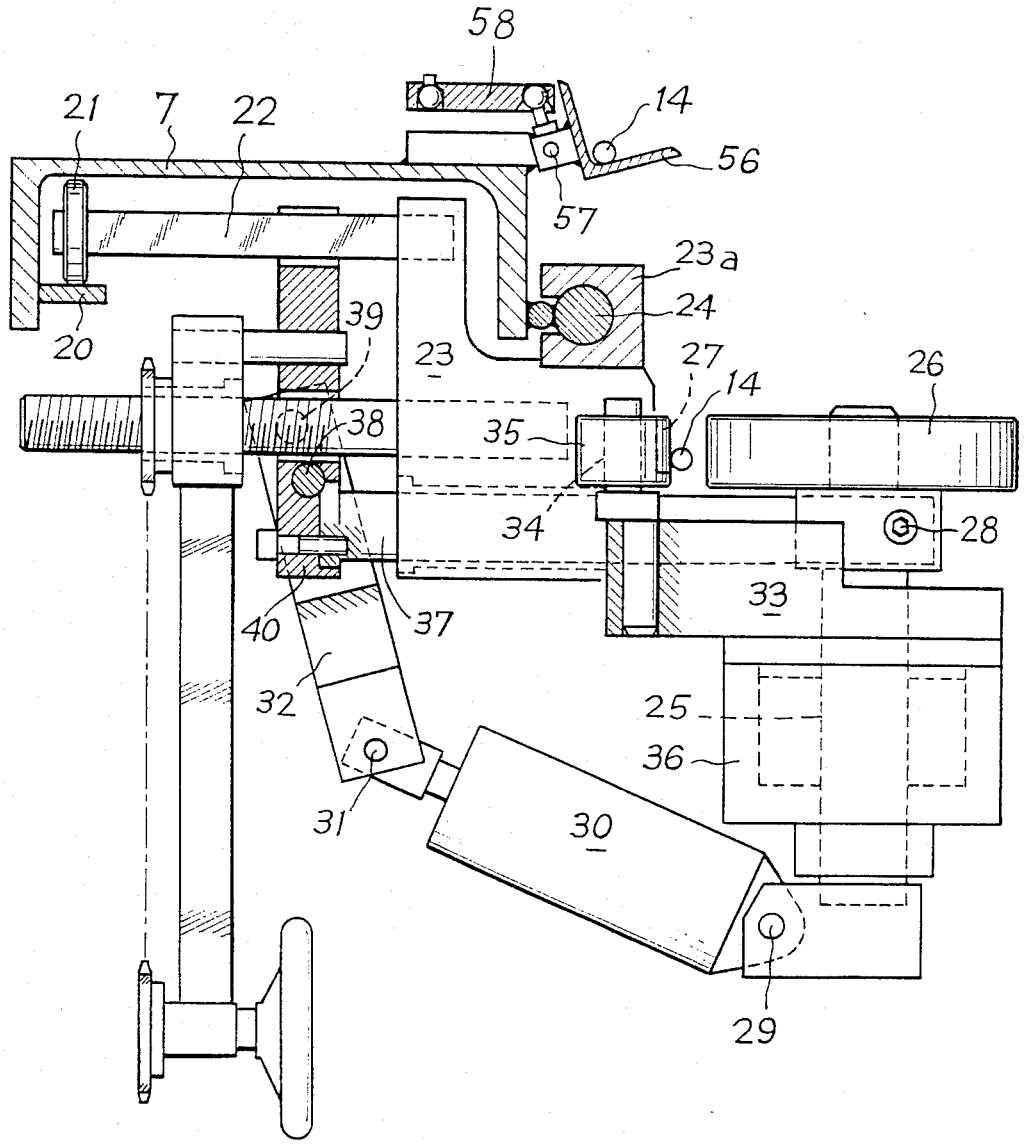
Figure 5:
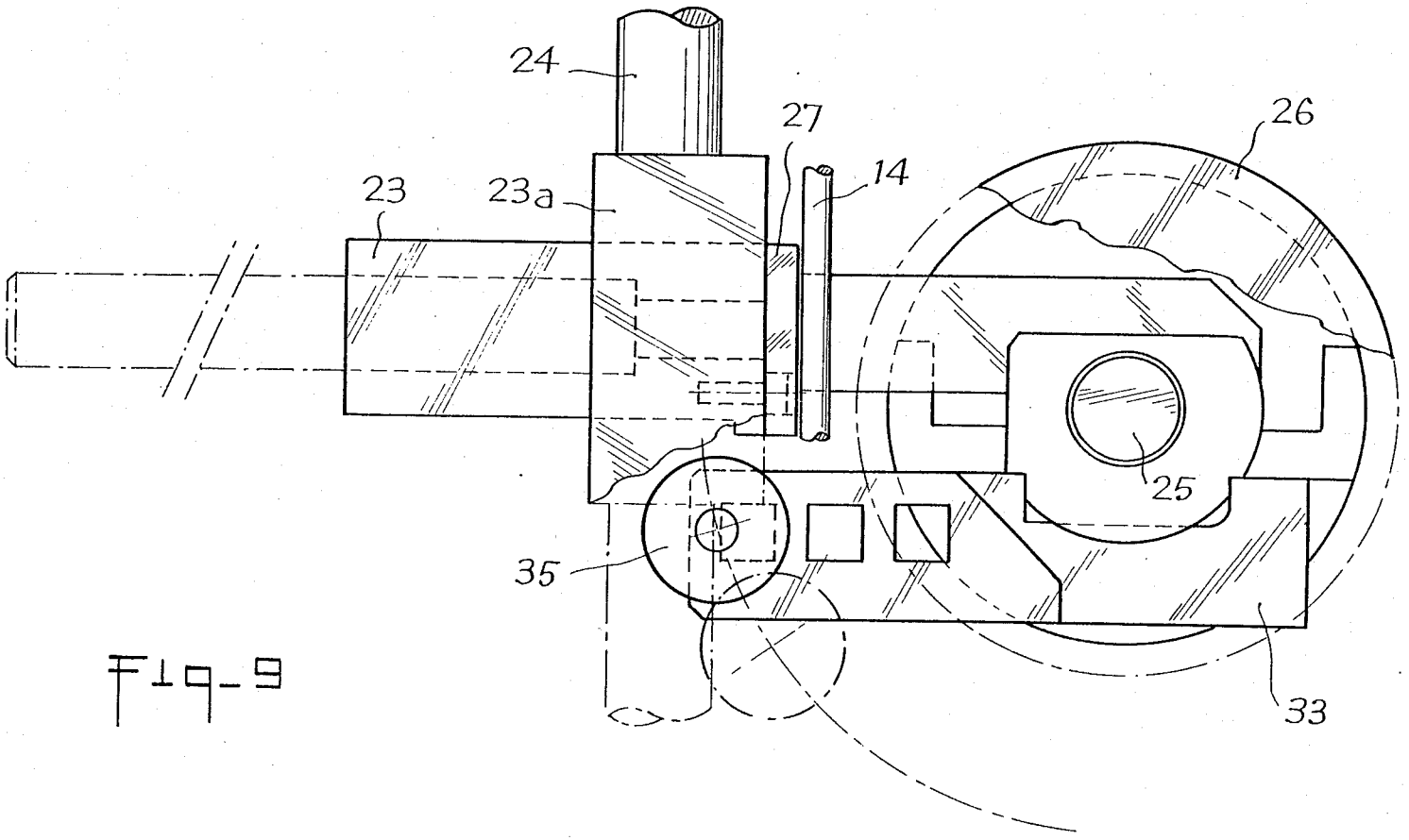
Figure 10:
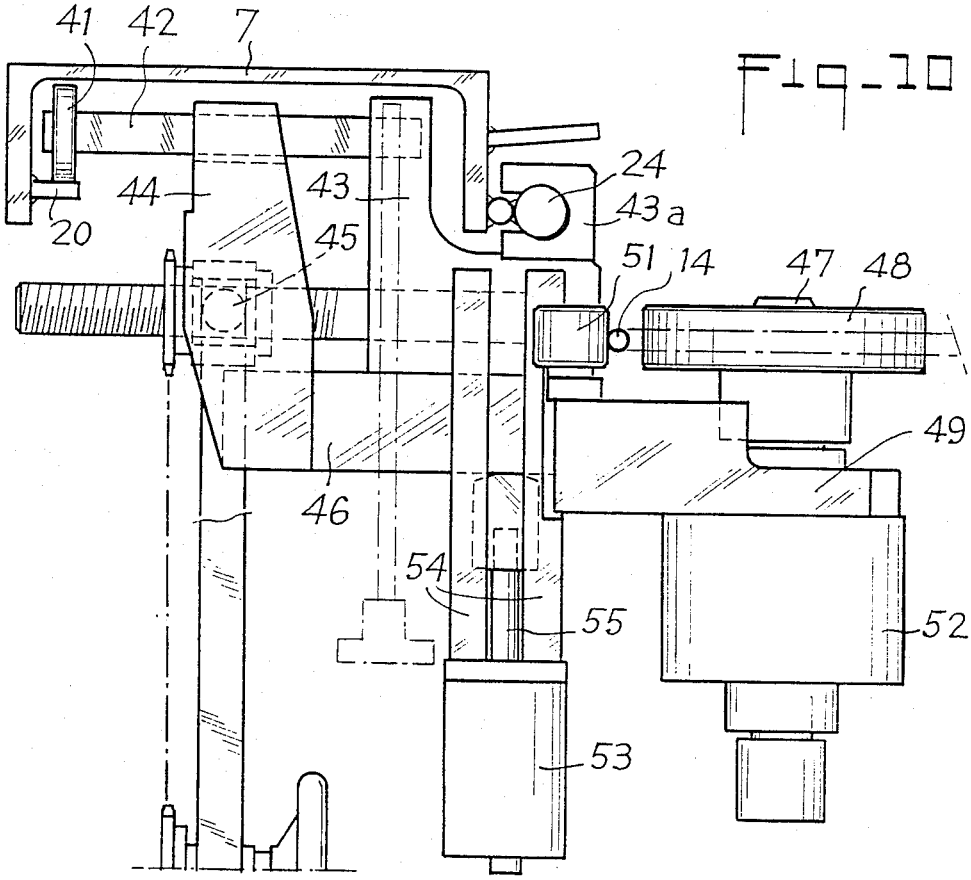
Figure 11:
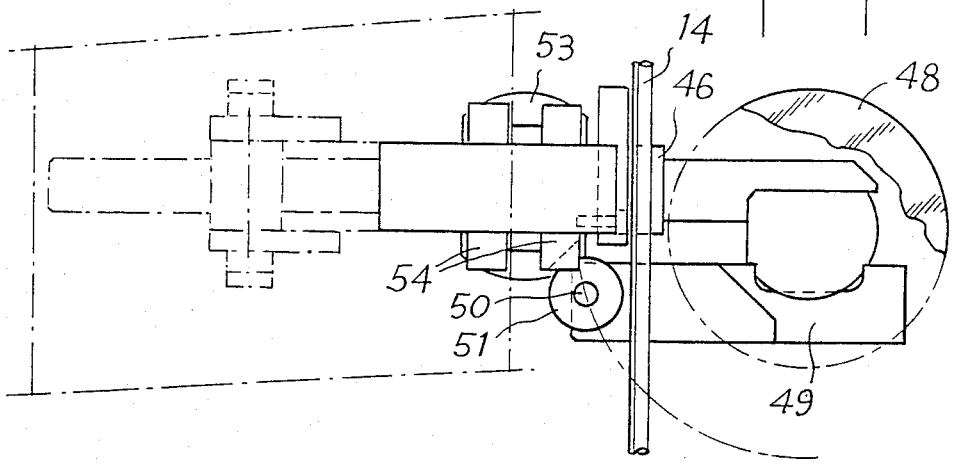

The invention will be more readily understood on reading the following description with reference to the accompanying drawings in which:

FIG. 1 is a plan view of one embodiment of the device according to the invention for producing and removing bar-like pieces, FIG. 2 is an elevational view of the device shown in FIG. 1, FIG. 3 is a cross-sectional view along line III—III of FIG. 2, FIG. 3*a* shows an alternative to the embodiment shown in FIG. 3, FIG. 4 is a plan view of the device during a first piece-shaping phase, FIG. 5 is a plan view of the device during a second piece-shaping phase, FIG. 6 is a plan view of the device during the finished piece-removal phase, FIG. 7 is a view of an installation composed of a plurality of devices according to the invention, FIG. 8 is a side elevation of a partial cross-section of one of the central means for shaping the piece, complete with a vice, FIG. 9 is a plan view showing in detail the shaping members of the means shown in FIG. 8, FIG. 10 is a side elevation of another piece-shaping means situated on the ends of the device, and FIG. 10*a* is a cross-sectional view of the rod and arm shown in FIG. 10, FIG. 11 is a plan view showing the shaping members of the means shown in FIG. 10.

Referring first to FIGS. 1, 2 and 3, these show one embodment of a device for producing and removing wire material pieces which comprises a frame 1 with support legs 2 equipped with wheels 3 permitting to wheel the frame on the ground, said frame being provided at the back with a space 4 defined at its lower part by an assembly of sections 5, and laterally by two sets of sections 6, 6*a*, the upper part of said space being open.

At the front of the frame 1, a beam 7 is secured on the top part of the assembly of sections 6.

Between the legs 2 of the frame 1 and underneath said frame there is provided a tray 8 resting on the ground by a set of wheels 9 permitting to move it under the frame 1 in a direction perpendicular to its longitudinal axis, said tray being designed for removing the finished pieces.

According to another embodiment, as shown in FIG. 3*a*, it is also possible to use other means for removing the finished pieces, such as for example an endless belt 8*a* mounted on rotating rollers 8*b*.

In the space 4 of the frame are mounted in known manner reels of wires 10 resting on the set of sections 5 and feeding wire 11 to a wire-straightening device 12 of a type such as claimed in French Patent Applicaton No. 82 03850. Next to said straightening device 12 cutting and length-measuring means 13 are mounted on the beam 7, which means 13 supply bars 14 of predetermined length to shaping means 15, 15*a* and 16, 16*a* mounted on the beam 7, to be described hereinafter in more detail.

During a first shaping phase, the bar 14 (FIG. 4) which is firmly gripped between the shaping means 15, 15*a* in the center part of the beam 7, is subjected at its ends to the action of the shaping means 16, 16*a* which form loops 17, 17*a* on the ends of the bar.

Then, the shaping means 16, 16*a* move to a retracted position, leaving a free passage for the two ends of the bar 14 to be shaped by the means 15, 15*a* in another machining phase (FIG. 5), during which the bar 14 is folded on each side at an angle of 90°.

The bar 14 being finally shaped, it is then ejected by known means not shown in the drawing, on to the tray 8 which is situated in front of the shaping means 15, 15*a* and 16, 16*a*. Said movable tray is thereafter moved to unload the pieces 18, 19 on each side of the device, as illustrated in FIG. 7.

Moreover, the frame 1 of the shaping device can be moved laterally to occupy positions 1*a*, 1*b*, thus ensuring the production and delivery in different points of the working area of sets of shaped bars, grouped up to suit the requirements of an assembly.

Instead of supplies by way of reels of wires and straightening devices as described hereinabove, it is also possible to use a system supplying already straightened bars. A continuity of the product can be achieved by using initially straight bars and the welding method.

FIGS. 8 and 9 show in more detail one of the means 15, 15*a* for shaping the bar 14 which means are situated in the center of the beam 7 where a track is provided said track being defined between one of its faces and a rail 20 on which moves a roller 21 mounted for rotating at the end of a rod 22 integral with a carriage 23 guided over the front face by a slide-block 23*a* moving on a longitudinal bar 24 secured on the beam 7.

On the carriage 23 is slidably mounted a bar 37 of which one end is fixed by a screw 28 on a shaft 25, the other end being integral with a slide-block 40 at one end of which is pivotally mounted a connecting rod 32 which is also mounted for pivoting on the carriage 23 about an axis 39. Said connecting rod 32 is pivotally mounted by its other end in 31 on the control-rod of a jack 30 pivotally mounted in 29 on the lower part of the shaft 25. A tightening-pulley 26 is mounted for free rotation at the top part of the shaft 25, which tightening-pulley is adapted to press the bar 14 tightly against a vice jaw 27 integral with the carriage 23.

An arm 33 is mounted for free rotation on the shaft 25, which arm is provided with an axle 34 on which a shaping roller 35 is mounted for free rotation, said arm 33 being driven in rotation by a rotary jack 36.

When the bar 14 is in resting contact against the jaw 27, the jack 30 is actuated, which jack causes, via the connecting rod 32 and the rod 37, the movement of the pulley 26 causing the latter to press the bar 14 against the jaw 27. Said bar 14 being thus gripped, the rotary jack 36 is actuated to move the arm 33 and the pulley 35 in rotation, said pulley acting on the bar 14 to fold it at an angle of 90° about the pulley 26.

FIGS. 10 and 11 show in more detail one of the means 16, 16*a* for shaping the bar 14 which is situated at the end of the beam 7 carrying the rail 20 on which moves a roller 41 mounted for rotating on the end of a rod 42 integral with a carriage 43 guided on the front face by a slide-block 43*a* moving over the longitudinal bar 24 secured on the beam 7.

A lever 46 is mounted for rotation about an axis 45 on one arm 44 adjustably mounted with respect to the carriage 43, said lever 46 carrying at one of its ends a shaft 47 on which a roller 48 is mounted for free rotation and an arm 49 is rotatably mounted, which arm is fitted at its free end with an axle 50 on which is rotatably mounted a shaping roller 51. Said arm 49 is driven in rotation by a rotary jack 52.

The relationship of arm 44 which may be shaped like a fork, and rod 42 is shown in FIG. 10*a*.

Moreover, the lever 46 is actuated by a jack 53 secured on the carriage 43 by guiding support arms 54, said jack being connected to the lever 46 by its sliding rod 55.

The members being in the position illustrated in block lines in FIG. 10, the rotary jack 52 is actuated, to move the arm 49 and the roller 51, said latter acting on the bar 14 to fold it over the roller 48 as illustrated in FIG. 4. Then, the jack 53 is actuated to pivot the lever 46 about the axis 45 and to bring the roller 48 in a retracted position thus allowing the passage of the bar 14 and its shaping by the central shaping means 15, 15*a*. Above the said shaping means an angle-piece 56 (FIG. 8) is mounted for pivoting about an axis 57 at the front of the beam, which angle-piece is connected with a drive-member 58, receives the bars 14 and supplies the shaping means.

The invention is in no way limited to the description given hereinabove and on the contrary covers any modifications that can be brought thereto without departing from its scope.

What I claim is:

1. Device for receiving, cutting, shaping and discharging elongated wire or bar material workpieces, said device comprising a movable, generally rectangular frame, a beam mounted along one longitudinal edge of said frame and carrying thereon measuring, cutting and shaping means for receiving said material workpieces, said frame further including a plurality of supporting legs for supporting said frame above the ground, said frame and said legs arranged to define a space beneath said frame configured to accomodate a receptacle means movable between receiving and discharging positions, to receive and selectively discharge shaped material workpieces from said device.

2. Device as claimed in claim 1, wherein said shaping means comprises a pair of carriages mounted for sliding longitudinally along said beam.

3. Device as claimed in claim 1, additionally comprising a workpiece-supplying member pivotally mounted above said shaping means and an actuating member connected to said workpiece-supplying member, wherein said workpiece-supplying member comprises an angle piece mounted for pivoting at the front of said beam under the action of said actuating means.

4. Device as claimed in claim 1, wherein said shaping means comprises a pair of shaping members mounted for sliding longitudinally along the center part of said beam, each of said members comprising a carriage including a vice jaw against which is pressed the workpiece, a support member, a jack pivotally connected to said support member, a tightening pulley mounted for free rotation on said support member, which pulley is adapted to press the workpiece against the vice jaw, an arm connected to said support member for pivoting about the axis of said tightening pulley, a driving member for pivotally moving said arm, and a shaping roller carried at the end of said arm, said shaping roller and said tightening pulley acting in cooperation for shaping the workpiece.

5. Device as claimed in claim 4, additionally comprising on either side of said pair of shaping members, a second pair of shaping members mounted for sliding longitudinally along said beam, each of said second pair of shaping members comprising a carriage on which a support member is pivotally mounted in retractable manner with respect to the workpiece, a holding roller mounted for free rotation on said support member, an arm connected to said support member which is pivotable about the axis of the holding roller, a driving member for pivotally driving said arm, and a shaping roller carried by said arm at its free end, said shaping roller cooperating with the holding roller to shape the workpiece.

6. Device for receiving, cutting, shaping and discharging elongated wire or bar material workpieces, said device comprising a movable, generally rectangular frame, a beam mounted along one longitudinal edge of said frame and carrying thereon measuring, cutting and shaping means for receiving said material workpieces, said frame further including a means for dispensing wire, a straightening means which straightens wire supplied by said dispensing means and which supplies wire to said measuring, cutting and shaping means, and a plurality of supporting legs for supporting said frame above the ground, said frame and said legs arranged to define a space beneath said frame configured to accommodate receptacle means movable between receiving and discharging positions, to receive and selectively discharge shaped material workpieces from said device.

7. Device for receiving, cutting, shaping and discharging elongated wire or bar material workpieces, said device comprising a generally rectangular frame, a beam mounted along one longitudinal edge of said frame and carrying thereon measuring, cutting and shaping means for receiving said material workpieces, said frame further including a plurality of supporting legs for supporting said frame above the ground, said frame and said legs arranged to define a space beneath said frame configured to accommodate receptacle means movable between receiving and discharing positions, to receive and selectively discharge shaped material workpieces from said device, and a receptacle means comprising a movable tray situated within the space beneath said frame.

8. Device as claimed in claim 7, wherein said receptacle means comprises a tray mounted on wheels, adapted to move beneath said frame and perpendicular to the longitudinal direction of said frame, wherein said supporting legs are mounted on wheels adapted for movement of said frame in a direction parallel to the longitudinal direction of said frame.

* * * * *